United States Patent [19]

Goplen

[11] 4,011,922

[45] Mar. 15, 1977

[54] MUFFLER CONSTRUCTION

[75] Inventor: Gary Dennis Goplen, Monona, Wis.

[73] Assignee: Nelson Industries, Inc., Stoughton, Wis.

[22] Filed: July 18, 1975

[21] Appl. No.: 597,030

[52] U.S. Cl. ..... 181/57; 181/36 C; 181/58; 181/66

[51] Int. Cl.[2] ..... F01N 1/08; F01N 3/06

[58] Field of Search ..... 181/57, 58, 66, 36 C, 181/69

[56] References Cited

UNITED STATES PATENTS

| | | | |
|---|---|---|---|
| 1,304,096 | 5/1919 | Redeker et al. | 181/58 |
| 2,115,128 | 4/1938 | Starkweather et al. | 181/57 |
| 2,350,924 | 6/1944 | Rainville | 181/58 |
| 2,732,026 | 1/1956 | Folts | 181/57 |
| 2,881,852 | 4/1959 | Morrish et al. | 181/57 |
| 3,374,857 | 3/1968 | Hutchins | 181/58 |
| 3,545,179 | 12/1970 | Nelson et al. | 181/58 |
| 3,687,225 | 8/1972 | Nelson | 181/57 |

*Primary Examiner*—Stephen J. Tomsky
*Attorney, Agent, or Firm*—Andrus, Sceales, Starke & Sawall

[57] ABSTRACT

A muffler construction for an internal combustion engine. The muffler includes a housing having an inlet to receive exhaust gases from the engine and having an outlet for the discharge of gases. Located between the inlet and the outlet are a pair of baffles which are disposed in parallel spaced relation and the space between the baffles defines a central chamber. The upstream baffle is provided with a central opening, while the downstream baffle has a closed central portion aligned with the opening in the upstream baffle. Louvered openings are provided in the downstream baffle radially outward of the closed central portion. The exhaust gases pass through the opening in the upstream baffle, strike the closed central portion of the downstream baffle, are deflected outwardly in the central chamber, and then pass through the louvered openings to the outlet.

11 Claims, 11 Drawing Figures

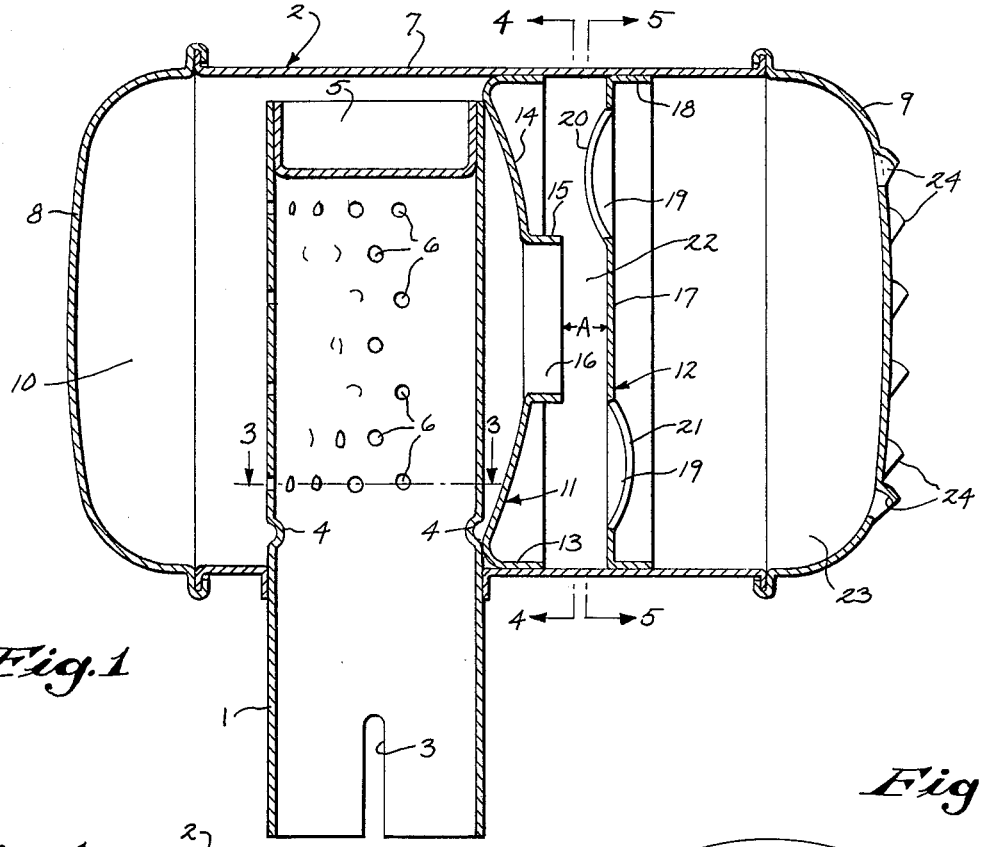
Fig.1
Fig.2
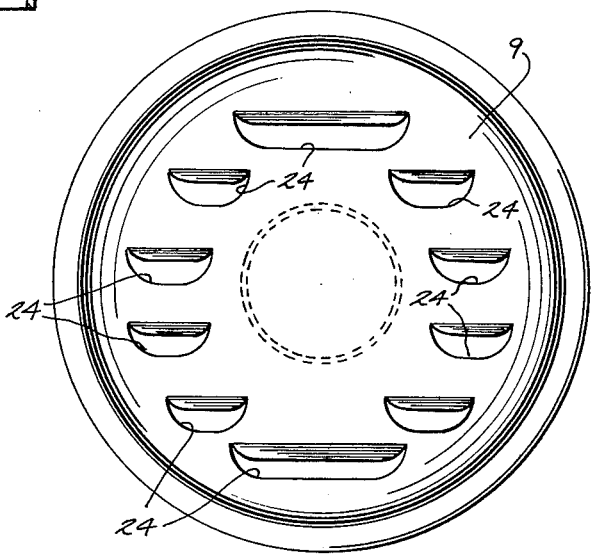
Fig.4
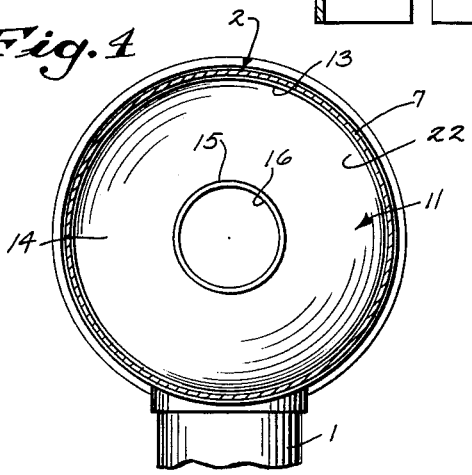
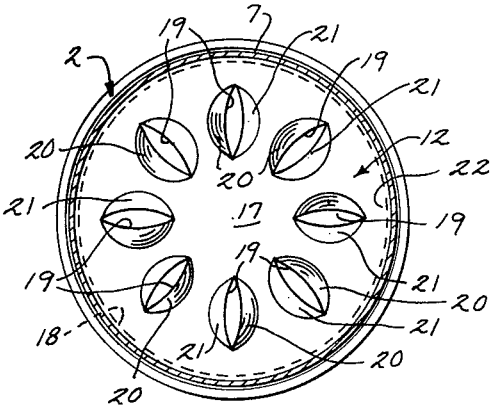
Fig.5
Fig.3
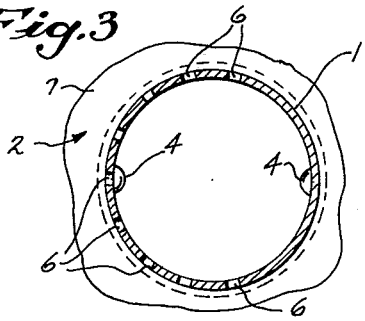

MUFFLER CONSTRUCTION

BACKGROUND OF THE INVENTION

A wide variety of mufflers of different constructions and configurations are used with internal combustion engines for the purpose of decreasing the acoustical energy of the exhaust gases and thereby reducing the noise pollution in the atmosphere. Generally, acoustical energy is reduced by passing the exhaust gases through a series of expansion chambers and restrictions. However, in most instances, size and shape limitations for the muffler are imposed by the engine manufacturer. Thus, the muffler design, in conforming to the engine manufacturer specifications, must provide a balance between the reduction of acoustical energy while minimizing back pressure in the muffler.

SUMMARY OF THE INVENTION

The invention relates to an improved muffler construction for an internal combustion engine which substantially reduces the output of acoustical energy as compared with conventional mufflers of similar size. The muffler of the invention includes an inlet pipe which is attached to the exhaust pipe of the engine, and the inlet pipe is secured within an opening in the muffler housing or body. Gases from the engine are conducted through the inlet pipe into an inlet chamber in the muffler body.

The muffler body also defines an outlet chamber having a series of discharge outlets through which the exhaust gases are discharged. Located between the inlet chamber and the outlet chamber are a pair of spaced generally parallel baffles and the space between the baffles comprises an intermediate chamber.

The upstream baffle is provided with a flanged central opening, while the downstream baffle has a closed central portion which is aligned with the opening in the upstream baffle. Louvered openings are provided in the peripheral portion of the downstream baffle radially outward of the closed central portion.

The exhaust gases entering the inlet chamber pass through the central opening of the upstream baffle and are deflected outwardly into the intermediate chamber and thereafter pass through the louvered openings to the outlet chamber for discharge. The louvered openings in the downstream baffle act to spin the exhaust gaes outwardly within the outlet chamber.

The muffler construction of the invention not only provides adequate flow of the exhaust gases through the muffler body to prevent excessive back pressure, but the combination of the two baffles substantially decreases the acoustical energy. The pressure waves passing through the central opening in the upstream baffle will strike the closed central portion of the downstream baffle and be almost completely reflected back into the inlet chamber. This reflection, in combination with the series of alternate expansions and restrictions as the gases pass from the inlet chamber to the intermediate chamber to the outlet chamber, substantially reduces the acoustical energy being ultimately discharged from the muffler.

The muffler construction of the invention can be utilized with various types of internal combustion engines, including small gasoline engines, such as those used with lawn mowers, roto-tillers, posthole diggers, snow throwers, and the like; motorcycle engines; automotive engines; and diesel engines.

Other objects and advantages will appear in the course of the following description.

DESCRIPTION OF THE DRAWINGS

The drawings illustrate the best mode presently contemplated of carrying out the invention.

In the drawings:

FIG. 1 is a sectional view of a muffler of the invention as used with a small gasoline engine;

FIG. 2 is an end view of the muffler of FIG. 1;

FIG. 3 is a section taken along line 3—3 of FIG. 1;

FIG. 4 is a section taken along line 4—4 of FIG. 1;

FIG. 5 is a section taken along line 5—5 of FIG. 1;

DESCRIPTION OF THE PREFERRED EMBODIMENT

Figure 6:
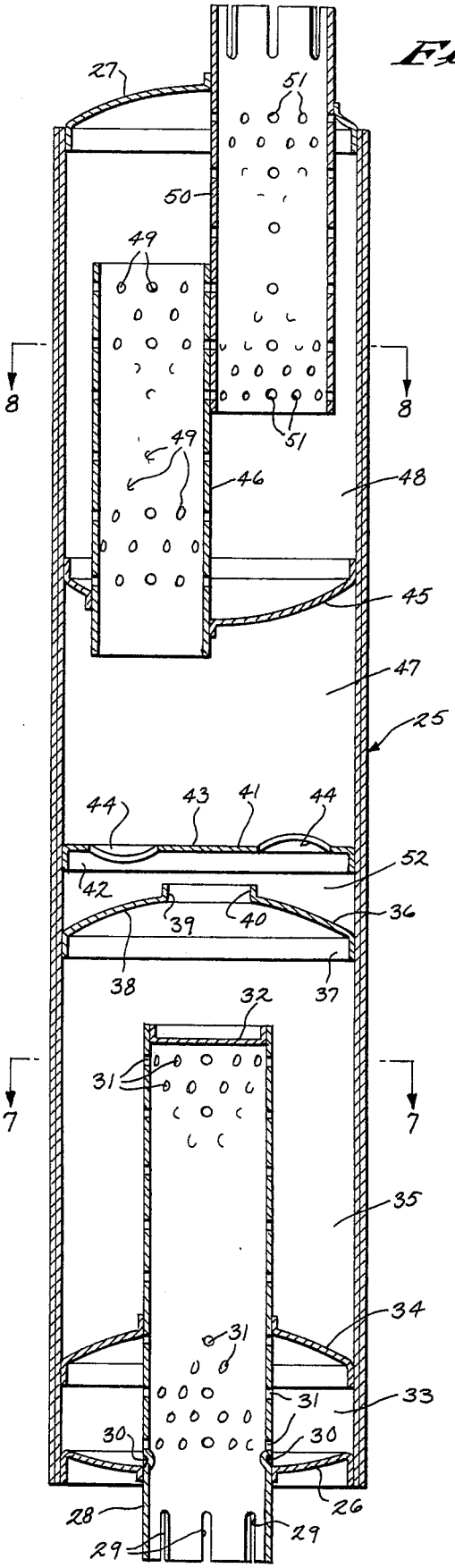
FIG. 6 illustrates a modified form of the invention in which a muffler is used with a diesel engine.

FIGS. 1–5 illustrate a muffler constructed in accordance with the invention for use with a small gasoline engine. The muffler includes an inlet tube 1 which is secured within an opening in a housing or body 2. The projecting end of the inlet tube 1 is adapted to be clamped around an exhaust pipe of an engine by a conventional clamping ring, and the end of the tube 1 is provided with a pair of slots 3 which facilitate crimping of the tube about the exhaust pipe.

Located generally at the midpoint of the length of the tube 1 are a pair of inwardly projecting indentations 4 which serve as stops and limit the insert of the exhaust pipe into the tube 1.

The inner end of the tube 1 is enclosed by flanged cap 5 and the exhaust gases are discharged from the tube 1 into the body 2 through a series of holes or perforations 6. The body 2 is composed of a generally cylindrical shell 7, the ends of which are enclosed by heads 8 and 9.

As shown in FIG. 3, the holes 6 in the inlet tube 1 are distributed through an arc of about 206°, and the holes face toward head 8 and extend from the indentations 4 to the cap 5. With this arrangement, the exhaust gases are directed through holes 6 toward the head 8 into the inlet chamber 10.

In accordance with the invention, a pair of baffles 11 and 12 are mounted within the muffler body 2 in closely spaced relation. The upstream baffle 11 is provided with a peripheral flange 13 which is welded to the inner surface of the shell 7 of the muffler body. The baffle 11, in combination with the shell 7 and the end head 8 defines the inlet chamber 10.

The baffle 11 has a generally convex body section, as indicated by 14, which terminates in an axial flange 15 bordering an opening 16.

As best illustrated in FIG. 1, the downstream baffle 12 is formed with a closed central section 17 which has a slightly greater diameter than the diameter of the opening 16 in the upstream baffle 11.

As in the case of baffle 11, the downstream baffle 12 is provided with a peripheral flange 18 which is welded to the inner surface of the shell 7. Located between the closed central section 17 and the flange 18 are a series of louvered openings 19, and each opening, as best shown in FIG. 5, is bordered by punchedout sections 20 and 21. The space between the baffles 11 and 12 comprises an intermediate chamber 22, while the space between the end head 9 and baffle 12 defines an outlet chamber 23. Louvered ports 24 provide communication between outlet chamber 23 and the atmosphere.

The sections 20 extend toward end head 8 while sections 21 face toward end head 9. The combination of the oppositely directed sections 20 and 21 cause the exhaust gases passing through the openings 19 to spin radially outward as they flow into the outlet chamber 23.

In operation, the exhaust gases from the engine flow through the exhaust pipe into the inlet tube 1 and pass through the holes 6 into the inlet expansion chamber 10. The gases then move through the opening 16 in baffle 11 and are deflected into the intermediate chamber 22 by the central section 17 of baffle 12. The gases then pass through the louvered openings 19 to the outlet chamber and are discharged from the outlet chamber 23 through the louvered ports 24 in the end head 9 to the atmosphere.

It has been found that the spacing between the downstream end of flange 15 and central section 17 (shown by A in FIG. 1), may be varied resulting in increased reduction of acoustical energy as this spacing is decreased. The spacing should be less than the diameter of the opening 16, and it has been found that a spacing of less than the radius of opening 16 will not result in excessive back pressure. The pressures waves pass through the restricted central opening 16 in baffle 11 and impinge upon the closed central portion 17 of the downstream baffle 12, and are reflected rearwardly. Depending on the angle of incidence, the pressure waves will be reflected back through opening 16 to inlet chamber 10, as well as into the intermediate chamber 22. This pattern of reflection of the pressure waves, in combination with the alternate expansions and restrictions, achieved through the chambers 10, 22 and 23, provides a substantial reduction in noise level of the muffler and yet does not appreciably increase the back pressure.

Figure 7:
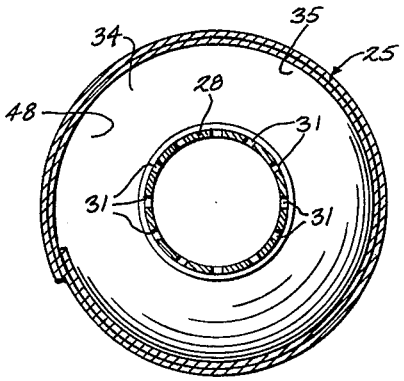
FIG. 7 is a section taken along line 7—7 of FIG. 6.
Figure 8:
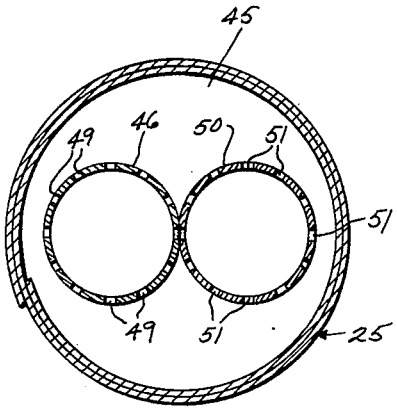
FIG. 8 is a section taken along line 8—8 of FIG. 6.

FIGS. 6–8 illustrate a modified form of the invention as utilized with a vertical type muffler to be employed with a large diesel engine. The muffler includes a generally cylindrical housing or body 25 which is enclosed at its ends by a pair of flanged end heads 26 and 27. The gases from the engine are conducted to the muffler through an inlet tube 28 which is welded within an opening in the head 26. The outer projecting end of the inlet tube 28 is adapted to be clamped around the exhaust pipe of the engine, and a series of slots 29 are formed in the end of the tube 28 to facilitate the crimping of the tube about the exhaust pipe by a standard clamping ring.

As in the case of the first embodiment, the tube is provided with a pair of inwardly extending indentations or dimples 30 which serve as a stop to limit the insertion of the exhaust pipe into the tube.

The portion of the inlet tube located within the body is provided with a plurality of outlet ports or holes 31 and the inner end of the tube is closed off by a flanged cap 32. A group of the ports 31 communicate with a closed resonating chamber 33 which is defined by the head 26, the body 25 and an annular baffle member 34 which is secured between the body and the tube 28.

A second group of the ports 31 in the inlet tube 28 communicate with a chamber 35, which is defined by the annular baffle 34, the body 25 and a baffle 36, similar in construction to baffle 11 of the first embodiment. The baffle 36, as previously described with respect to baffle 11, includes a peripheral flange 37 which, is welded to the inner surface of the body 25 and the central portion of the baffle is convex in shape, as indicated by 38 and terminates in an axial flange 39 which defines an opening 40.

Located in closely spaced relation to baffle 36, is a second baffle 41 which corresponds to baffle 12 of the first embodiment. The baffle has a peripheral flange 42, which is secured to the inner surface of the body, and a closed central portion 43 which is aligned with the central opening 40 in the baffle 36. Positioned between the peripheral flange 42 and the closed central portion 43 are a series of louvered openings 44, similar to louvered openings 19 of the first embodiment.

Located downstream of the baffle 41, is a baffle 45 which is secured to the inner surface of body 25 and an outlet tube 46 is secured within an opening in the baffle 45. The space between the baffles 41 and 45 defines chamber 47, while the space between the baffle 45 and the end head 27 provides an outlet chamber 48.

The tube 46 is formed with a series of holes 49 which extend around the circumference of the tube, and the greater portion of the exhaust gases flowing within the tube 46 will be discharged from the end of the tube into chamber 48, while a smaller portion of the gases pass rapidly outward through the holes 49 into chamber 48.

Secured in lapping relation to the tube 46 is a second tube 50 having an outlet end that projects from the end head 27 and is adapted to be connected to a discharge pipe. Tube 50 is open-ended and is also provided with a series of holes or ports 51 which are located around the periphery of the tube. The exhaust gases within the chamber 48 will flow into the open inner end of the tube 50, as well as into the ports 51 and will be discharged from the outer end of the tube.

In operation, the exhaust gases enter the inlet tube 28 and a portion of the gases pass through the ports 31 into the resonating chamber 33, while the second portion of the gases are discharged through the ports into the chamber 35 and pass through the opening 40 in baffle 36 and impinge against the closed central portion 43 of the baffle 41. As previously described in connection with the first embodiment, the gases are deflected outwardly and rearwardly into the chamber 52, between baffles 36 and 41, then flow through the louvered openings 44 into the chamber 47, through the tube 46, to the outlet chamber 48 and ultimately through the discharge tube 50.

As described with respect to the first embodiment, the combination of closely spaced baffles 36 and 41, not only substantially reduces the acoustical energy of the exhaust gases, but provides a system which will not create excessive back pressure and therefore will not adversely effect engine performance.

Figure 9:
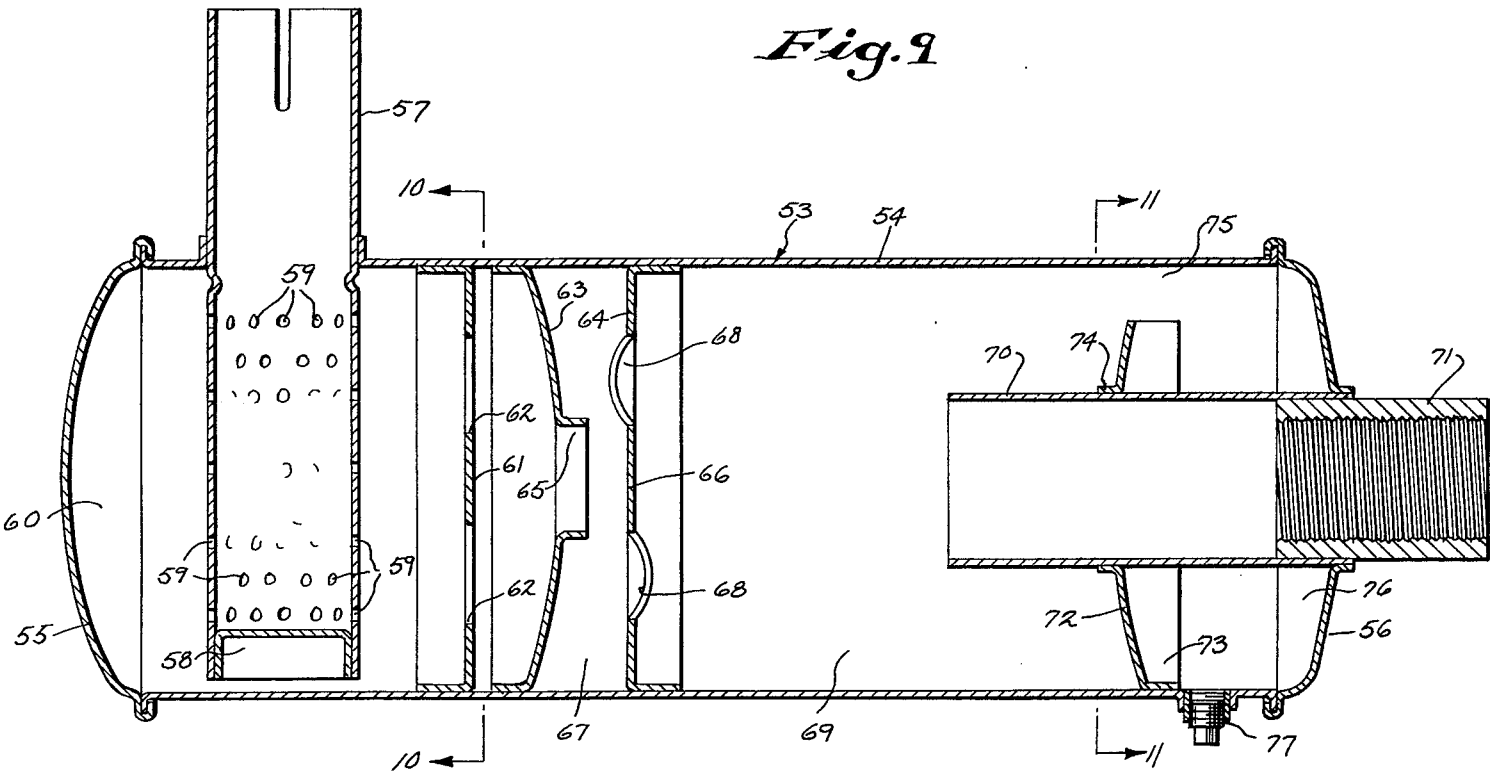
FIG. 9 is a second modified form of the invention in which the muffler incorporates a spark arrestor.
Figure 11:
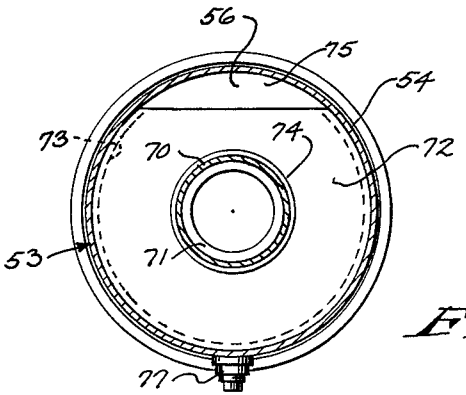
FIG. 11 is a section taken along line 11—11 of FIG. 9.
Figure 10:
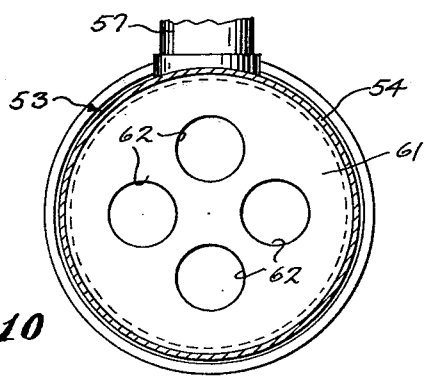
FIG. 10 is a section taken along line 10—10 of FIG. 9.

FIGS. 9–11 illustrate a further modified form of the invention as utilized with a muffler including a spark arrestor.

The muffler comprises a housing or body 53 composed of a cylindrical shell 54 which is enclosed at the ends by heads 55 and 56. The exhaust gases from the internal combustion engine are delivered to the muffler through an inlet tube 57, which is similar in construction to inlet tube 1 of the first embodiment. The inner end of tube 57 located within the housing 53 is enclosed by a flanged cap 58 and the tube is provided with a plurality of outlet holes or ports 59 through which the exhaust gases are conducted to the inlet chamber 60.

Secured across the shell is a baffle plate 61 having a series of openings 62 through which the exhaust gases are conducted. Located downstream of the baffle plate 61 are baffles 63 and 64 which are identical in construction and operation to baffles 11 and 12 of the first embodiment.

The holes 62 in the baffle plate 61 are arranged so that they are not in direct alignment with the central opening 65 of baffle 63, so that the exhaust gases will not flow directly into the central opening, but instead will be deflected outwardly before entering the central opening.

As previously described, the exhaust gases passing through central opening 65 in baffle 63 impinge against the closed section 66 of baffle 64 and are deflected rearwardly and outwardly into the intermediate chamber 67. The gases then flow through the louvered openings 68 into the outlet chamber 69 which is defined by the shell 54 and the end head 56. An outlet tube 70 is located centrally within the head 56 and the outer projecting end of the tube carries a threaded coupling 71 which is adapted to receive a discharge pipe.

As illustrated in FIG. 9, a baffle 72 is spaced upstream of the head 56 and baffle 72 is provided with a peripheral flange 73 which is welded to the inner surface of the shell 54. The central portion of the baffle is formed with an annular flange 74 that is welded to the tube 70.

As illustrated in FIG. 11, a sector of the baffle 72 is removed to provide an opening or notch 75. As previously described, the exhaust gases are spun outwardly after passing through the louvers 68 and the carbon particles, being heavier, will move along the surface of the shell by centrifugal force and pass through notch 75, to be collected in the chamber 76. A removable plug 77 is engaged with an opening communicating with chamber 76 so that the carbon particles can be periodically removed from the chamber.

The combination of the two baffles, such as 63 and 64 provides a substantial improvement in the reduction of the noise level, without producing an undue restriction to the flow of exhaust gases through the muffler.

The invention can be incorporated with any type of muffler for an internal combustion engine, including mufflers associated with small gasoline engines, motorcycles, snowmobiles, automobiles, farm and construction equipment, trucks, diesel engines, and the like, as well as silencers for use in the reduction of acoustical energy in any gas flow, without causing excessive back pressures.

Various modes of carrying out the invention are contemplated as being within the scope of the following claims particularly pointing out and distinctly claiming the subject matter which is regarded as the invention.

I claim:

1. A muffler for an internal combustion engine, comprising a housing having an exhaust gas inlet and an exhaust gas outlet, a pair of baffle members disposed in generally parallel spaced relation within said housing with the space between said baffle members defining an intermediate chamber, the upstream baffle member having an opening for the passage of exhaust gas and said downstream baffle members having a closed portion disposed in alignment with said opening in the upstream baffle member, the spacing between said baffle members is less than the diameter of said opening, and outlet means disposed in said downstream baffle member between said closed portion and the periphery of said downstream baffle member, said outlet means providing communication between said intermediate chamber and said outlet.

2. The muffler of claim 1, wherein the area of said closed portion is greater than the area of said opening.

3. The muffler of claim 1, wherein said upstream baffle member has an annular flange bordering said opening, said flange extending toward said downstream baffle member, the spacing between the downstream end of said flange and said downstream baffle member is less than the diameter of said opening.

4. The muffler of claim 1, wherein said housing defines an inlet chamber located upstream of said upstream baffle member, and said muffler includes an inlet tube connected to said inlet and communicating with said inlet chamber.

5. The muffler of claim 4, wherein said inlet tube has a closed inner end located within said inlet chamber and has a plurality of ports providing communication between the interior of said inlet tube and said inlet chamber.

6. The muffler of claim 4, wherein said ports face generally in a direction away from said upstream baffle.

7. The muffler of claim 4, wherein the spacing between said baffle members is less than the radius of said opening.

8. A muffler comprising, a housing having an inlet to receive exhaust gases and a discharge outlet to discharge the gases, a first upstream baffle member disposed transversely of said housing and having a single axial opening therein, a second downstream baffle member disposed in closely spaced parallel relation to said first baffle member and extending transversely across said housing, the space between said baffle members defining an intermediate chamber, said second baffle member having a central closed portion disposed in alignment with said opening and said closed portion having a greater area than said opening, the spacing between the portion of the upstream baffle member bordering said opening and the closed portion of the downstream baffle member being less than the radius of said opening, and a series of apertures disposed in said downstream baffle member and located radially outward of said central portion for conducting gases from the intermediate chamber to the discharge outlet, and louver means associated with said apertures for causing the gas passing from said apertures to spin radially outward.

9. The muffler of claim 8, and including spark arrestor means disposed in said housing between said downstream baffle member and said discharge outlet.

10. The muffler of claim 9, wherein said spark arrestor means comprises a third baffle member disposed between said downstream baffle member and said downstream end of the housing with the space between the third baffle member and said downstream baffle member comprising a discharge chamber and the space between the third baffle member and the downstream end of the housing comprising a spark arrestor chamber, and port means located in said third baffle member adjacent the wall of the housing and providing communication between the discharge chamber and the spark arrestor chamber, carbon particles in said gas spinning outwardly along said housing wall and through said port means for collection in said spark arrestor chamber.

11. A muffler comprising, a housing, a first baffle member disposed transversely of said housing and having a single axial opening therein, a second baffle member disposed in closely spaced parallel relation to said first baffle member and extending transversely across said housing, said second baffle member having a central closed portion disposed in alignment with said opening and said closed portion having a greater area than said opening, the space between said first baffle member and an end of said housing defining an inlet chamber, the space between said baffle members defining an intermediate chamber and the space between said second baffle member and the opposite end of the housing defining a discharge chamber, inlet conduit means for introducing exhaust gas into said inlet chamber, said inlet conduit means having a closed end and having a plurality of ports providing communication between the interior of said inlet conduit means and said inlet chamber, discharge conduit means communicating with the discharge chamber for discharging gases from said discharge chamber, the spacing between the portion of the first baffle member bordering said opening and the closed portion of the second baffle member being less than the diameter of said opening, a series of apertures disposed in said second baffle member and located radially outward of said central portion for conducting gases from the intermediate chamber to the discharge chamber, and louver means associated with said apertures for causing the gas passing from said apertures to spin radially outward.

* * * * *

UNITED STATES PATENT AND TRADEMARK OFFICE

CERTIFICATE OF CORRECTION

PATENT NO. : 4,011,922

DATED : March 15, 1977

INVENTOR(S) : GARY DENNIS GOPLEN

It is certified that error appears in the above-identified patent and that said Letters Patent are hereby corrected as shown below:

Column 4, Line 31, Cancel "rapidly" and substitute therefor

---radially---

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*